US010577158B2

(12) United States Patent
Wurster et al.

(10) Patent No.: US 10,577,158 B2
(45) Date of Patent: Mar. 3, 2020

(54) PRESSURE EQUALIZING CLOSURE

(75) Inventors: Michael P. Wurster, York, PA (US); Scott E. Bysick, Elizabethtown, PA (US); Robert Waltemyer, Felton, PA (US); Paul Kelley, Wrightsville, PA (US)

(73) Assignee: GRAHAM PACKAGING COMPANY, L.P., Lancaster, PA (US)

( * ) Notice: Subject to any disclaimer, the term of this patent is extended or adjusted under 35 U.S.C. 154(b) by 1864 days.

(21) Appl. No.: 13/016,380

(22) Filed: Jan. 28, 2011

(65) Prior Publication Data

US 2011/0186536 A1 Aug. 4, 2011

Related U.S. Application Data

(60) Provisional application No. 61/299,612, filed on Jan. 29, 2010.

(51) Int. Cl.
*B65D 51/16* (2006.01)
*B65D 79/00* (2006.01)

(52) U.S. Cl.
CPC ..... *B65D 51/1616* (2013.01); *B65D 79/005* (2013.01)

(58) Field of Classification Search
CPC ..... B65D 51/1616; B65D 79/005
USPC ..... 215/271; 220/203.15, 203.28, 261, 371, 220/580
See application file for complete search history.

(56) References Cited

U.S. PATENT DOCUMENTS 3,448,862 A 6/1969 Roy
3,951,293 A 4/1976 Schulz
4,002,516 A 1/1977 Gaborieau et al.
4,135,635 A 1/1979 Fujii et al.
(Continued)

FOREIGN PATENT DOCUMENTS

JP WO/2008/065879 A1 * 11/2007 ..... B65D 51/18
WO WO 98/23496 6/1998

OTHER PUBLICATIONS

International Search Report and Written Opinion dated May 23, 2011 for corresponding international application No. PCT/US2011/022974.

*Primary Examiner* — James N Smalley
(74) *Attorney, Agent, or Firm* — Stradley Ronon Stevens & Young, LLP

(57) ABSTRACT

The present invention provides a closure for a hot-fill container comprising: a cap member having a top surface, a bottom surface, and a wall portion having an outer surface and an inner surface wherein the inner surface comprises threads to mate with a threaded neck finish of a hot-fill container; a flexible diaphragm member comprising: at least one flexible portion in a first position and a sealing lip portion to seal a liquid in the container thus preventing the liquid from traveling to the threaded neck finish of the container; and a disc member interposed between the cap member and the diaphragm member, wherein the disc member comprises: a hydrophobic filter membrane and at least one vent providing a path for air to travel from an area near the threads to the hydrophobic filter member, wherein the flexible diaphragm member flexes to compensate for a change in pressure within the container by transitioning downwards in response to a decrease in pressure and/or by transitioning upwards in response to an increase in pressure.

10 Claims, 4 Drawing Sheets

(56) References Cited

U.S. PATENT DOCUMENTS

| | | | | |
|---|---|---|---|---|
| 4,174,784 | A | 11/1979 | Hartung | |
| 6,572,812 | B2 | 6/2003 | Collette et al. | |
| 6,602,309 | B2 * | 8/2003 | Vizulis et al. | 55/385.4 |
| 7,001,564 | B1 | 2/2006 | Geisinger | |
| 7,107,928 | B2 | 9/2006 | Chasteen et al. | |
| 7,278,548 | B2 | 10/2007 | Rieck et al. | |
| 7,581,654 | B2 | 9/2009 | Stowitts | |
| 7,621,412 | B2 | 11/2009 | Raniwala | |
| 7,832,579 | B2 | 11/2010 | Lohrman et al. | |
| 2007/0224374 | A1 | 9/2007 | Kelley | |
| 2007/0228058 | A1 | 10/2007 | Brown | |
| 2008/0011708 | A1 | 1/2008 | Rappin | |
| 2008/0173613 | A1 | 7/2008 | Ross | |
| 2009/0057263 | A1 | 3/2009 | Barker et al. | |
| 2009/0101620 | A1 | 4/2009 | O'Brien | |
| 2009/0179032 | A1 | 7/2009 | Livingston | |
| 2010/0084397 | A1 * | 4/2010 | Kubo et al. | 220/256.1 |

* cited by examiner

PRESSURE EQUALIZING CLOSURE

BACKGROUND OF THE INVENTION

The present invention relates generally to container closures, and more particularly to closures for use in containers that may experience internal pressure changes once sealed such as, for example, hot-fill containers and containers subject to pasteurization processes.

The background of the present invention will be described in connection with closures for hot-fill applications. It should be understood, however, that the use of the closure of the present invention has wider applicability and can be employed on any type of container.

Internally threaded, plastic cap closures have found widespread application for use in connection with hot-fill plastic containers by virtue of their low manufacturing costs and sealing performance. In a conventional hot-fill process, a hot beverage product is introduced into the plastic container, typically filling most of the container. The fluid is heated during a pasteurization or sterilization process to remove bacteria or other contamination. The plastic container is hermetically sealed with a cap while the product is still hot. Since the beverage product is typically not filled to the top of the container, a headspace of air is provided between the liquid enclosed within the plastic container and an inner surface of the cap. The temperature of the liquid varies from a high of about 205° F., the typical hot-fill temperature, to about 40° F., the typical refrigeration temperature. A change in temperature, from hot to cold, decreases the internal pressure of the sealed container and creates a vacuum within the container primarily as a result of the thermal contraction of the liquid in the container. This decrease in pressure can distort and/or deform the geometry of the container if the container cannot structurally support the pressure difference between the external ambient pressure and the lower internal pressure of the container. Deformation of the container generally pushes the fluid upwardly and decreases the headspace volume. For example, for a typical 16-ounce container, thermal contraction equates to roughly 3% of the total liquid volume, or 0.9 cubic inches when the stored contents are cooled from about 185° F. to about 40° F.

Current containers are engineered to collapse at specific locations or are reinforced with vacuum panels and/or flexible bases to compensate for the vacuum. Vacuum-reactive mechanisms are very efficient to maintain a balanced pressure and keep the remaining structural geometry of the container from collapsing. Further, labeling of the container is difficult because containers employing raised and/or recessed vacuum panels possess reduced surface area. The reduction of surface area also restricts the ornamental design of the label, restricts the placement of the label, and often leads to unattractive wrinkling of the label.

There have been attempts to prevent container deformation by designing plastic closures that will compensate for the vacuum created by the cooling of a hot-filled liquid. For example, U.S. Pat. No. 7,621,412 discloses a cap that includes an air permeable membrane covering a through-hole in the cap to permit pressure equalization between the interior of the container and the ambient atmosphere during cooling of the container's contents. This design, however, allows air to be pulled directly into the product and requires the membrane be plugged to seal the contents of the container from further ingress or egress of fluids. U.S. patent application Publication No. 2007/0228058 discloses an expandable plastic closure that flexes in response to pressure. This closure includes a series of elevated substantially flat concentric panels of varying diameters. This design, however, potentially allows for uneven top surfaces of the sealed cooled containers. Finally, U.S. patent application Publication No. 2009/0179032 discloses a plastic closure having an expandable bellows that extend within the neck of the closure. During attachment of such closure to the neck of the container, the bellows is compressed to force air positioned therein into the container which creates a pressure increase within the container. The pressure increase is sufficiently large such that when the container is cooled, a pressure decrease sufficient enough to distort the container allegedly will not form. A disadvantage of this design is that there are multiple components that are susceptible to contamination behind the compressed liner/bellows and the disclosed configuration would not be readily adaptable to a pasteurization process where internal pressure would be increased.

Accordingly, there is a need in the art for a plastic closure that will significantly reduce or prevent container deformation by compensating for the vacuum created by the liquid hot-fill/subsequent cooling process without suffering from the above-mentioned drawbacks.

BRIEF SUMMARY OF THE INVENTION

The present invention satisfies this need by providing a closure for a hot-fill container comprising: a cap member having a top surface, a bottom surface, and a wall portion having an outer surface and an inner surface wherein the inner surface comprises threads to mate with a threaded neck finish of a hot-fill container; a flexible diaphragm member comprising: at least one flexible portion in a first position and a sealing lip portion to seal a liquid in the container thus preventing the liquid from traveling to the threaded neck finish of the container; and a disc member interposed between the cap member and the diaphragm member, wherein the disc member comprises: a hydrophobic filter membrane and at least one vent providing a path for air to travel from an area near the threads to the hydrophobic filter member, wherein the flexible diaphragm member flexes to compensate for a change in pressure within the container by transitioning downwards in response to a decrease in pressure and/or by transitioning upwards in response to an increase in pressure.

In another aspect, the present invention provides a closure for a hot-fill container comprising: a cap member having a top surface, a bottom surface, and a wall portion having an outer surface and an inner surface wherein the inner surface comprises threads to mate with a threaded neck finish of a hot-fill container, wherein the cap member further comprises a through-hole between the top and bottom surface wherein the through-hole comprises a hydrophobic filter membrane; and a flexible diaphragm member comprising: at least one flexible portion in a first position and a sealing lip portion to seal a liquid in the container thus preventing the liquid from traveling to the threaded neck finish of the container, wherein the flexible diaphragm member flexes to compensate for a change in pressure within the container by transitioning downwards in response to a decrease in pressure and/or by transitioning upwards in response to an increase in pressure.

BRIEF DESCRIPTION OF SEVERAL VIEWS OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

Embodiments of the present invention described herein are directed to an apparatus and method for accommodating the internal pressure changes associated with packaging operations such as, for example, hot filling and subsequently cooling a liquid stored in a plastic container, pasteurization, and cold-fill aseptic. By addressing the pressure changes within the container via the closure, vacuum panels on the container walls may be eliminated or reduced.

As used herein, the term "liquid" generally refers to the contents of a container sealed with the closure of the present invention and includes a free flowing substance such as, for example, fruit juice, and sports drinks; however, the term also includes a semi-free flowing substance such as, for example, ketchup and applesauce.

In one embodiment, the present invention provides a closure for a hot-fill container comprising a cap member having a top surface, a bottom surface, and a wall portion having an outer surface and an inner surface wherein the inner surface comprises threads to mate with a threaded neck finish of a hot-fill container. The closure also comprises a flexible diaphragm member comprising at least one flexible portion in a first position and a sealing lip portion to seal a liquid in the container thus preventing the liquid from traveling to the threaded neck finish of the container. The closure still further comprises a disc member interposed between the cap member and the diaphragm member, wherein the disc member comprises: a hydrophobic filter membrane and at least one vent providing a path for air to travel from an area near the threads to the hydrophobic filter member, wherein the flexible member is capable of moving to a second position after a seal is made and the liquid is either hot filled or heated to a temperature above 100° F. and finally the flexible member is capable of moving to a third position when the liquid is cooled.

The closures of the present invention are suitable for use with any container that may be susceptible to internal pressure changes (increases or decreases). Such container may be metal (e.g., aluminum) or plastic such as, for example plastic containers that are typically blow molded from an injection-molded preform that may be made from various polymer resins, such as polyesters, polyolefins, polycarbonates, nitrites and copolymers thereof. Bi-axially oriented polyethylene terephthalate (PET) is preferred.

Processes that may cause internal pressure changes of a sealed container include, for example, hot-fill applications, pasteurization applications, and transportation conditions such as changes in external temperature and pressure.

Figure 1B:
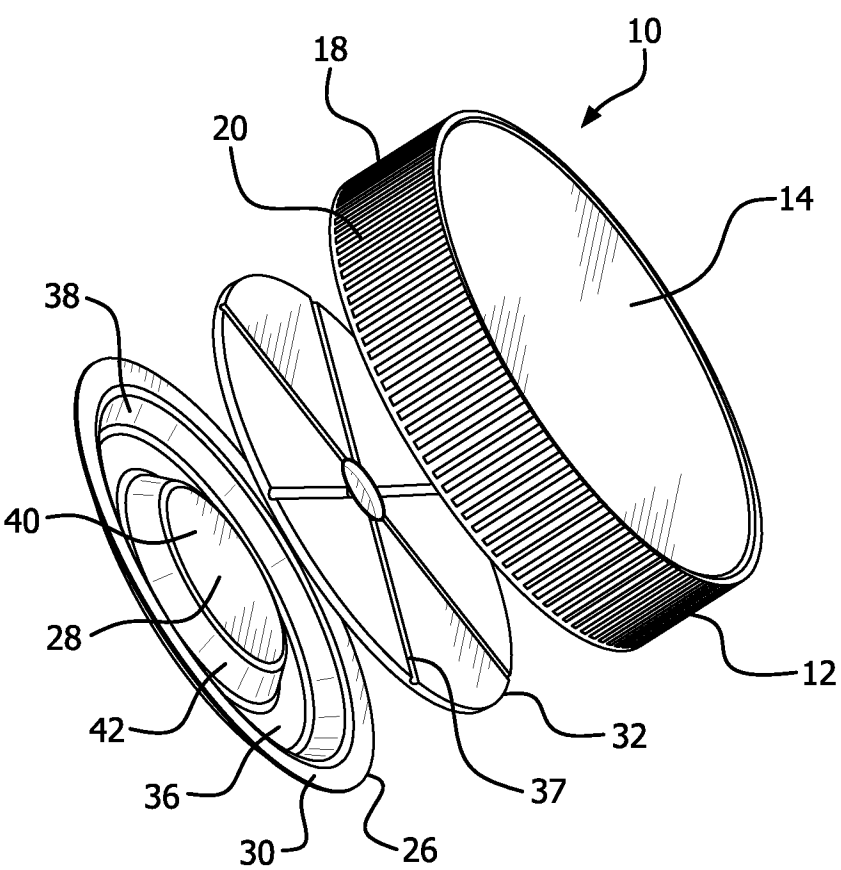
FIG. 1B is a partial top view of the embodiment shown in FIG. 1A1.
Figure 1A:
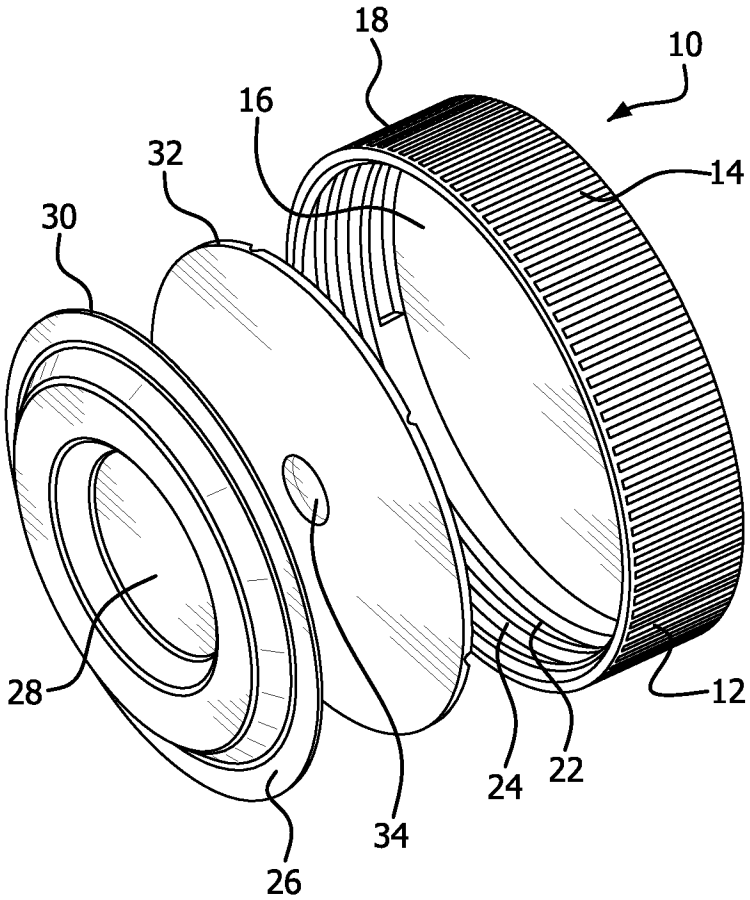
FIG. 1A is a partial bottom view of each component of one embodiment of the present invention.

A preferred embodiment of the closure of the present invention is depicted in FIG. 1A and FIG. 1B. Closure 10 is defined by a cap member 12 having a top surface 14, a bottom surface 16, and a wall portion 18 having an outer surface 20 and an inner surface 22 wherein the inner surface 22 comprises threads 24 to mate with a threaded neck finish of a hot-fill container (not shown). Cap member 12 can be made from any suitable polymeric material such as, for example, polypropylene or polyethylene polymer. Closure 10 may also include a tamper-evident ring (not shown).

Still referring to FIG. 1A and FIG. 1B, closure 10 includes a flexible diaphragm member 26. Flexible diaphragm member 26 includes sealing lip portion 30. In the present invention, sealing lip portion 30 functions to seal a liquid in the container thus preventing the liquid from traveling to the threaded neck finish of the container.

Flexible diaphragm member 26 further includes at least one flexible portion 28 in a first position. In the present invention, flexible portion 28 functions to compensate for a change in pressure by, for example, transitioning downwards toward the contents of the container in response to a decrease in head space pressure caused by the cooling of the liquid contents to, for example, at least room temperature and, for some applications, cooler than room temperature. In other embodiments, flexible portion 28 will transition upwards in response to an increase in pressure caused by, for example, a pasteurization process (i.e., prior to a cooling process which would then cause a reversal of the upward transition). Preferably, flexible portion 28 responds to such pressure change(s) preferentially over the walls of the container thus allowing the container to substantially maintain its shape after, for example, the container is hot-filled with a liquid, sealed, and the liquid is allowed to cool.

In the embodiment shown in FIG. 1A and FIG. 1B, flexible portion 28 comprises a recessed portion 36 (i.e., relative to lip portion 30), the depth of which is defined by the depth of recessed wall 38, and a raised portion 40, the height of which is defined by the height of wall 42. Wall 42 may be designed such that it has less material so it may respond more readily to changes in pressure within a sealed container. In other embodiments of the present invention, flexible portion 28 may have the shape of a bellows, may be flat, or may have a plurality of bubble-like portions each of which respond to changes in head space pressure.

Preferably, flexible diaphragm member 26 is made of a flexible plastic material. Suitable flexible plastic materials include, for example, any suitable thermoplastic polymer, thermoset rubber, or co-polymer or mixture thereof. Preferred thermoplastic polymers are generally: elastomer (TPE) styrenics; polyolefins (TPO), low density polyethylene (LDPE), high-density polyethylene (HDPE), linear low-density polyethylene (LLDPE), ultra low-density polyethylene (ULDPE); polyurethanes (TPU) polyethers and polyesters; etheresterelastomers (TEEEs) copolyesters; polyamides (PEBA); melt processible rubbers (MPR); vulcanizates (TPV); and mixtures and/or co-polymers thereof. Preferred thermoset rubbers are generally: butadiene rubber (BR); butyl rubber (IIR or PIB); chlorosulfonated polyethylene (CSM); epichlorohydrin rubber (ECH or ECO); ethylene propylene diene monomer (EPDM); ethylene propylene rubber (EPR); floroelastomers (FKM); nitrile rubber (NBR); perfluoroelastomer (FFKM); polyacrylate rubber (ASM); polycholorprene (CR); polyisoprene (IR); polysulfide rubber (PSR); silicon rubber (SiR); styrene butadiene rubber (SBR); and mixture and/or co-polymers thereof.

In other embodiment, flexible diaphragm member 26 is made of a flexible metal foil such as, for example, tin or aluminum.

Referring again to FIG. 1A and FIG. 1B, closure 10 further includes a disc member 32 interposed between the cap member 12 and the diaphragm member 26. Disc member 32 may be made from any of the materials listed above in connection with the flexible diaphragm member 26.

Disc member 32 includes a hydrophobic filter membrane 34. Preferably, hydrophobic filter membrane 34 is air permeable but not permeable to water vapor or other contaminants such as, for example, microbial contaminants. In the present invention, hydrophobic filter membrane 34 functions to allow the equalization of pressure inside the container upon the cooling of hot-filled liquid by allowing air to pass through the membrane as the flexible diaphragm member 26 transitions to its second position.

Preferably, hydrophobic filter membrane 34 is made of a hydrophobic material such as, for example, expanded polytetraflouro-ethylene (ePTFE), polypropylene, or a mixture thereof. In some embodiments of the present invention, hydrophobic filter membrane 34 is a laminate comprising a layer of expanded polytetraflouro-ethylene (ePTFE), polypropylene, or a mixture thereof, and a backing layer such as, for example, a layer of polyester felt to provide additional strength. Preferably hydrophobic filter membrane 34 has a porosity of between about 20 percent and 40 percent, and preferably 30 percent, with an average pore size of from about 0.3 to 5.0 microns. Preferably, the pore size is from about 0.4 to 2.0 microns, and, more preferably from about 0.5 to 1.5 microns. In practice, an average pore size of about 1.0 micron has been found to provide satisfactory results.

Exemplary hydrophobic filters according to the present invention have a diameter of from about 0.150" to about 0.500", and preferably from about 0.188" to about 0.375". Exemplary hydrophobic filters according to the present invention also have a water entry pressure (WEP) of from about 8 psi to about 15 psi. As used herein, the term "water entry pressure" (also known as water breakthrough pressure) refers to the pressure at which water can be forced through the hydrophobic vent filter media. Testing is typically performed by applying a vacuum of 400 mm Hg to the hole in the liner on the opposite side of the laminated PTFE filter media while at the same time covering the filter media with water. After 15 seconds, an observation is made to verify that no water or water droplets have passed or formed on the opposite side of the filter media on or near the hole in the liner. Exemplary hydrophobic filters according to the present invention also have an Airflow/Gurley # of from about ≤5.3 to about ≤7.0. As used herein, the term "Airflow/Gurley #" refers to the measure of air flow resistance of the filter media. The test is typically performed by taking 1 sq. in. of material and measuring the time to pass a given amount of air through the media at a given pressure (ASTM D726-58). The test is typically performed using a Gurley Densometer Model #4100, 4110, or 4120. Hydrophobic filter membranes for use in accordance with this invention are commercially available from, for example, Performance Systematix Inc. (Grand Rapids, Mich.).

Still referring to FIG. 1A and FIG. 1B, disc member 32 further includes at least one vent 37 providing a path for air to travel from an area near the threads to the hydrophobic filter member 34. As shown in FIG. 1B, the at least one vent 37 is a series of grooves that extend outwardly from the filter membrane 34 towards the area near the threads. In the embodiment shown in FIG. 1B, the grooves are spaced apart radially every 45° around disc member 32, which is circular in shape. In other embodiments, the grooves can be spaced apart radially 15°, 90°, or 180°.

In still other embodiments, hydrophobic filter member 34 is not centrally located on disc member 32. In such embodiments, the at least one vent 37 comprises at least one groove fluidly connecting hydrophobic filter member 34 to the area near the threads to allow for air flow to and from hydrophobic filter member 34. In other embodiments, the at least one groove comprises two intersecting grooves.

The following explains the operation of closure 10 in the context of a hot-fill application and is not intended to be limited thereto. In operation, closure 10 is placed on the neck of a portion of a container and immediately after the container is hot-filled (e.g., 205° F.) with a liquid beverage. Upon contact, lip portion 30 of flexible diaphragm member 26 forms a seal with the container thus preventing the liquid from traveling to the threaded neck finish of the container. The seal also prevents the escape of gas located in the headspace of the container. As closure 10 is rotated and tightened, air remains in the area of threads 24. As the liquid cools, the internal pressure of the sealed container decreases and creates a vacuum within the container primarily as a result of the thermal contraction of the liquid in the container. In response to the internal pressure decrease, flexible diaphragm member 26 flexes downward toward the liquid and pulls air into a space between flexible diaphragm member 26 and disc member 32 thus reducing the pressure in the container (which includes the headspace). The air is pulled by the diaphragm through the at least one vent 37 from the area of the threads 24 through hydrophobic filter membrane 34 without permitting moisture or other contaminants to permeate the hydrophobic filter membrane 34. In a preferred embodiment, hydrophobic filter membrane 34 is a dynamic two-way filter in that it allows air to travel both to and from the area of threads 24 through the membrane 34 toward flexible diaphragm member 26 such that the closure of the present invention will allow for pressure changes under conditions where the internal pressure of the container decreases and/or increases.

Figure 2B:
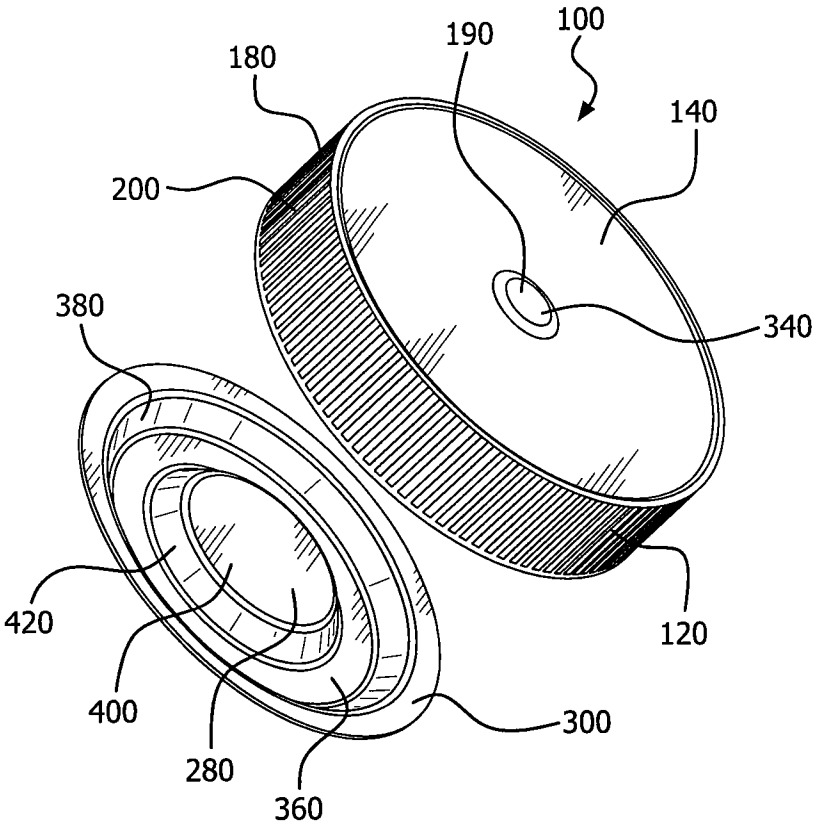
FIG. 2B is a partial top view of the embodiment shown in FIG. 2A.
Figure 2A:
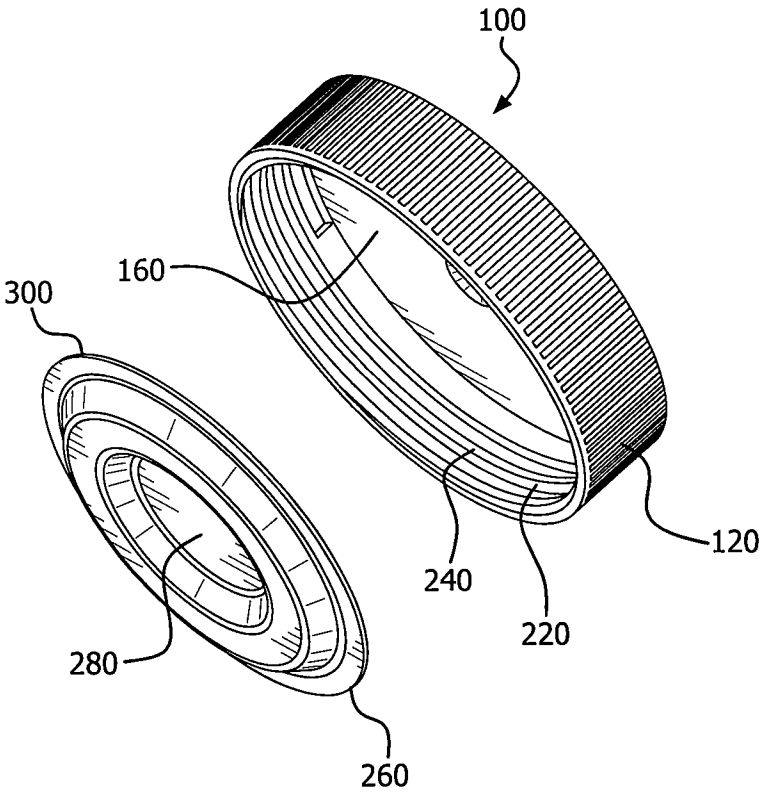
FIG. 2A is a partial bottom view of each component of another embodiment of the present invention.

FIG. 2A and FIG. 2B disclose another preferred embodiment of the present invention. Closure 100 is defined by a cap member 120 having a top surface 140, a bottom surface 160, and a wall portion 180 having an outer surface 200 and an inner surface 220 wherein the inner surface 220 comprises threads 240 to mate with a threaded neck finish of a hot-fill container (not shown). Cap member 120 can be made from any suitable polymeric material such as, for example, polypropylene or polyethylene polymer. Closure 100 may also include a tamper-evident ring (not shown).

As shown in FIG. 2A and FIG. 2B, cap member 120 comprises a through-hole 190 comprising a hydrophobic filter membrane 340. Preferably, hydrophobic filter membrane 340 is air permeable but not permeable to water vapor or other contaminants such as, for example, microbial contaminants. In the present invention, hydrophobic filter membrane 340 functions to allow the reduction of pressure inside the container upon the cooling of hot-filled liquid by allowing air to pass from the ambient environment through the membrane 340. Hydrophobic filter membrane 340 may be fixed to either top surface 140 or bottom surface 160 by any means known to those skilled in the art.

In some embodiments, the through-hole comprising hydrophobic filter member 340 is centrally located on cap member 120. In other embodiments, the through-hole comprising hydrophobic filter member 340 is not centrally located on cap member 120.

Preferably, hydrophobic filter membrane 340 is made of a hydrophobic material such as, for example, expanded polytetraflouro-ethylene (ePTFE), polypropylene, or a mixture thereof. In some embodiments of the present invention, hydrophobic filter membrane 34 is a laminate comprising a layer of expanded polytetraflouro-ethylene (ePTFE), polypropylene, or a mixture thereof, and a backing layer such as, for example, a layer of polyester felt to provide additional strength. Preferably hydrophobic filter membrane 340 has a porosity of between about 20 percent and 40 percent, and preferably 30 percent, with an average pore size of from about 0.3 to 5.0 microns.

Preferably, the pore size is from about 0.4 to 2.0 microns, and, more preferably from about 0.5 to 1.5 microns. In practice, an average pore size of about 1.0 micron has been found to provide satisfactory results. The diameter of hydrophobic filter membrane 340 (and, therefore, the size of the hole occupied by the filter membrane) may be on the order of 50 microns to 100 microns. Hydrophobic filter membranes for use in accordance with this invention are commercially available from, for example, Performance Systematix Inc. (Grand Rapids, Mich.).

Still referring to FIG. 2A and FIG. 2B, closure 100 also includes a flexible diaphragm member 260. Flexible diaphragm member 260 includes sealing lip portion 300. In the present invention, sealing lip portion 300 functions to seal a liquid in the container thus preventing the liquid from traveling to the threaded neck finish of the container.

Flexible diaphragm member 260 further includes at least one flexible portion 280 in a first position. In the present invention, flexible portion 280 functions to compensate for a change in pressure by, for example, transitioning downwards toward the contents of the container in response to a decrease in head space pressure caused by the cooling of the liquid contents to, for example, at least room temperature and, for some applications, cooler than room temperature. In other embodiments, flexible portion 280 will transition upwards in response to an increase in pressure caused by, for example, a pasteurization process. Preferably, flexible portion 280 responds to such pressure change(s) preferentially over the walls of the container thus allowing the container to substantially maintain its shape after the container experiences an internal pressure change such as, for example, when it is hot-filled with a liquid, sealed, and the liquid is allowed to cool.

In the embodiment shown in FIG. 2A and FIG. 2B, flexible portion 280 comprises a recessed portion 360 (i.e., relative to lip portion 300), the depth of which is defined by the depth of recessed wall 380, and a raised portion 400, the height of which is defined by the height of wall 420. Wall 420 may be designed such that it has less material so it may respond more readily to changes in pressure within a sealed container. In other embodiments of the present invention, flexible portion 280 may have the shape of a bellows, may be flat, or may have a plurality of bubble-like portions each of which respond to changes in head space pressure.

Preferably, flexible diaphragm member 260 is made of a flexible plastic material. Suitable flexible plastic materials include, for example, any suitable thermoplastic polymer, thermoset rubber, or co-polymer or mixture thereof. Preferred thermoplastic polymers are generally: elastomer (TPE) styrenics; polyolefins (TPO), low density polyethylene (LDPE), high-density polyethylene (HDPE), linear low-density polyethylene (LLDPE), ultra low-density polyethylene (ULDPE); polyurethanes (TPU) polyethers and polyesters; etheresterelastomers (TEEEs) copolyesters; polyamides (PEBA); melt processible rubbers (MPR); vulcanizates (TPV); and mixtures and/or co-polymers thereof. Preferred thermoset rubbers are generally: butadiene rubber (BR); butyl rubber (IIR or PIB); chlorosulfonated polyethylene (CSM); epichlorohydrin rubber (ECH or ECO); ethylene propylene diene monomer (EPDM); ethylene propylene rubber (EPR); floroelastomers (FKM); nitrile rubber (NBR); perfluoroelastomer (FFKM); polyacrylate rubber (ASM); polycholorprene (CR); polyisoprene (IR); polysulfide rubber (PSR); silicon rubber (SiR); styrene butadiene rubber (SBR); and mixture and/or co-polymers thereof.

In other embodiment, flexible diaphragm member 260 is made of a flexible metal foil such as, for example, tin or aluminum.

The following explains the operation of closure 100 in the context of a hot-fill application and is not intended to be limited thereto. In operation, closure 100 is placed on the neck of a portion of a container and after the container is hot-filled (e.g., 205° F.) with a liquid beverage. Upon contact, lip portion 300 of flexible diaphragm member 260 forms a seal with the container thus preventing the liquid from traveling to the threaded neck finish of the container. The seal also prevents the escape of gas located in the headspace of the container. As the liquid cools, the internal pressure of the sealed container decreases and creates a vacuum within the container primarily as a result of the thermal contraction of the liquid in the container. In response to the internal pressure decrease, flexible diaphragm member 260 flexes downward towards the liquid and pulls air into a space between flexible diaphragm member 260 and the bottom surface 160 of cap member 120 thus reducing the pressure in the container (which includes the headspace). Air from the ambient environment is pulled by the flexible diaphragm member 260 through hydrophobic filter membrane 340 without permitting moisture and other contaminants to permeate the hydrophobic filter membrane 340. In a preferred embodiment, hydrophobic filter membrane 340 is a dynamic two-way filter in that it allows air to travel both to and from the ambient environment through the membrane 340 toward flexible diaphragm member 260 such that the closure of the present invention will allow for pressure changes under conditions where the internal pressure of the container decreases and/or increases.

In embodiments where the hydrophobic filter membrane 340 is located on cap member 120 (i.e., through top surface 140 and bottom surface 160), it is not necessary to provide an air-tight seal to plug the hydrophobic filter membrane 340 because the flexible diaphragm member 260 provides the seal between the liquid beverage and the ambient environment, thus preventing contamination. Accordingly, the closures of this embodiment of the present invention are free from plugs (i.e., air-tight seals) between the hydrophobic filter membrane 340 and the ambient environment.

An advantage to embodiments of the present invention is that the closure may accept all of the volume change of a hot-filled container where other closures cannot. Embodiments of the closure may be molded from a plastic or other suitable flexible material, and may change shape to compensate for the change in internal pressure due to hot fill. Compensating for the pressure change primarily in the closure rather than the container body will allow greater design freedom for label panels, and assist in reducing the weight of the container.

Additionally, in an exemplary embodiment, the closure may be in contact with the product in the container and/or have the capability to sense the temperature of the product in the container. The closure may have the capability to change color or shape with heat. This would be useful, for example, if the container were for a bottled coffee, or soup, or a beverage for a child. The color or shape could indicate if the product is at a predetermined temperature, or too hot.

In another exemplary embodiment, a figure or figurine may form or be attached to the closure. When the product in the container is heated, for example, in a microwave, the pressure buildup inside the container may cause a flexible portion of the figure to either depress or extend, for example, the figure's eyes or tongue may bulge, or other features of the figure may change shape, indicating a heated or overheated product.

In an exemplary embodiment, the closure may have a diameter of greater than or equal to 28 millimeters (mm). In another exemplary embodiment, the closure may have a diameter of up to about 120 mm. In another exemplary embodiment, the closure may have a diameter of between about 63 mm to about 120 mm. In another exemplary embodiment, the closure may be used on containers of between about eight ounces to about five gallons.

Based on the foregoing, the method of the present invention should be self-evident. Either the cap member or a disc member is provided with a through-hole that is covered with a hydrophobic, air permeable membrane. When the container is filled with a hot liquid, the closure of the present invention is applied to the filled container. The container is then cooled to ambient temperature. During cooling, by the action of the flexible diaphragm member, air passes through the membrane to permit reduction between the pressure on the interior of the container and ambient pressure.

The following examples are provided for the purpose of further illustrating the present invention but are by no means intended to limit the same.

EXAMPLES

Hot Fill—Heavyweight Ribbed 24 oz PET Container v. Lightweight Thin-Walled 24 oz PET Container Without Ribs 63 mm three-component closures according to the present invention were made as follows. The liner was removed from a commercially available 63 mm plastic closure and fitted with an aftermarket 63 mm vented disc with a hydrophobic filter (wherein the filter is available from Performance Systematix Inc., Grand Rapids, Mich.), and a simple hinged liner design fabricated in house with a two piece aluminum mold and plastisol material. The liner was adhered to the vented disk using two sided tape. The disc/liner combination was then placed into the linerless closure.

For this experiment, two types of bottles were employed for comparison. the first type of bottles were lightweight (~39 g), 24 oz, thin walled (~0.018") plastic PET bottles with no vacuum panels, rib structure, or any other means of passive vacuum displacement. The second type of bottles were heavyweight (~48 g), 24 oz, plastic PET bottles with rib structures.

Figure 3:
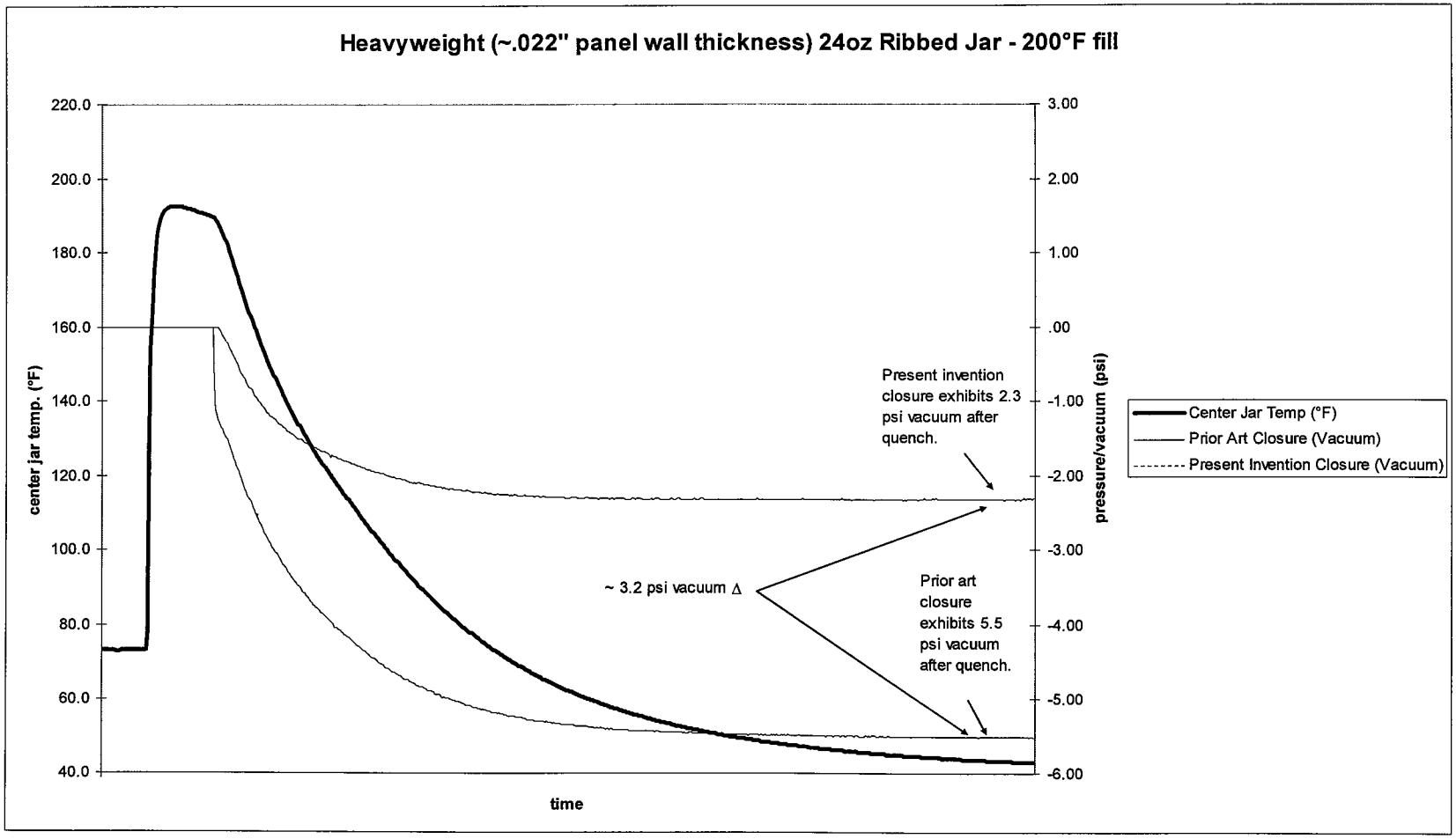
FIG. 3 is a graph illustrating the performance of an embodiment of the present invention compared to a standard closure.
Figure 4:
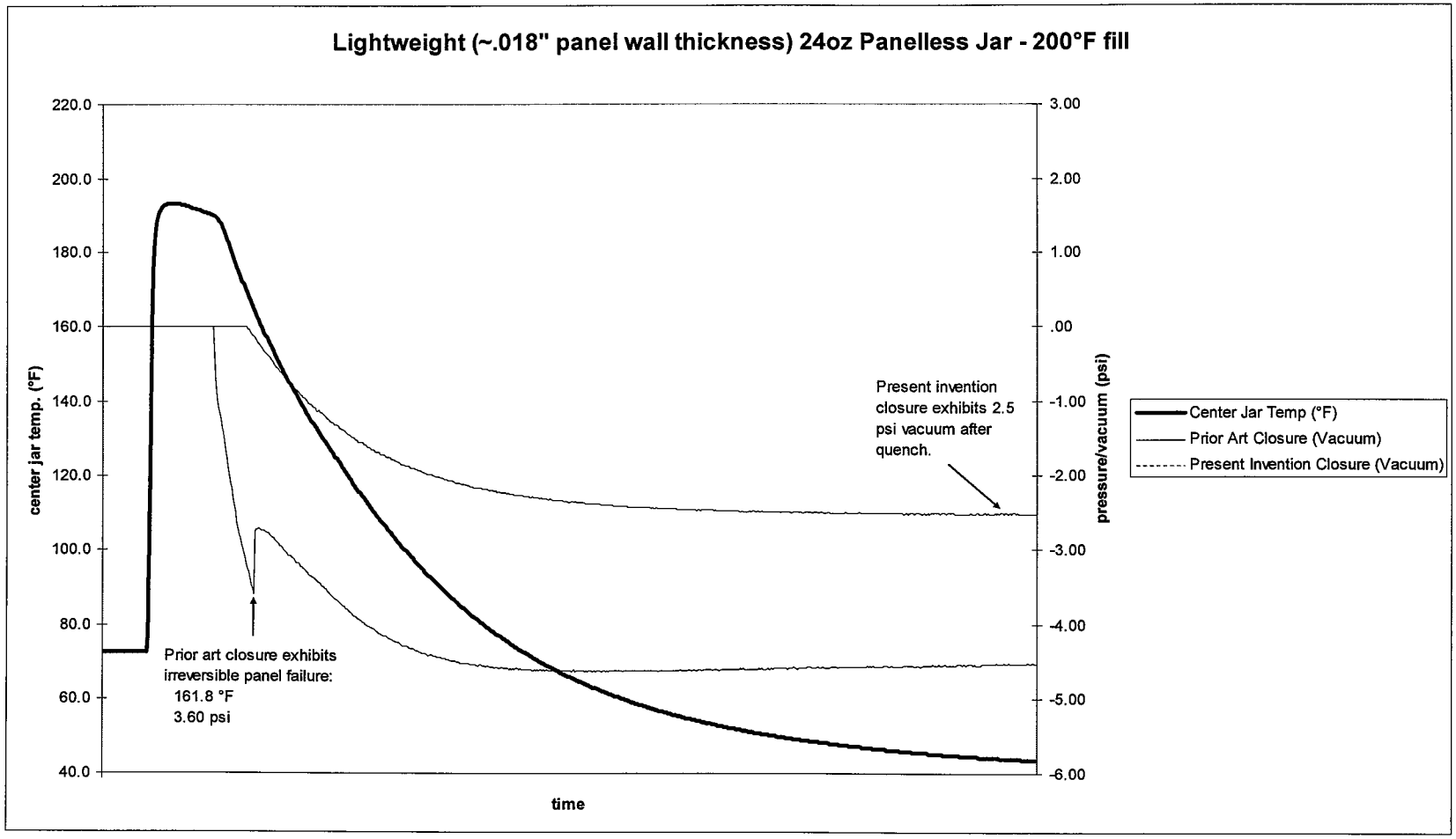
FIG. 4 is a graph illustrating the performance of an embodiment of the present invention compared to a standard closure.

For each type of container, two of the containers were hot-filled at 200° F. wherein one was capped with a standard one piece 63 mm closure, and the other was capped with the above-assembled closure according to the present invention. The results are shown graphically in FIGS. 3 and 4. FIG. 3 shows that the closure of the present invention achieved a vacuum of about −2.0 psi versus about −5.5 psi in the standard closure when employed with the heavyweight container. FIG. 4 shows that the lightweight container with the standard closure triangulated severely as expected as the liquid cooled. The container with the vacuum closure of the present invention, however, remained round with minimal ovality. This experiment also shown that the closure of the present invention can be used to achieve lighter weighted containers without sacrificing performance for hot fill applications.

The foregoing examples and description of the preferred embodiments should be taken as illustrating, rather than as limiting the present invention as defined by the claims. As will be readily appreciated, numerous variations and combinations of the features set forth above can be utilized without departing from the present invention as set forth in the claims. Such variations are not regarded as a departure from the spirit and scope of the invention, and all such variations are intended to be included within the scope of the following claims.

The invention claimed is:

1. A closure for a hot-fill container comprising:

a. a cap member having a top surface, a bottom surface, and a wall portion having an outer surface and an inner surface wherein the inner surface comprises threads to mate with a threaded neck finish of a hot-fill container;

b. a flexible diaphragm member comprising: at least one flexible portion in a first position and a sealing lip portion to seal a liquid in the container thus preventing the liquid from traveling to the threaded neck finish of the container; and c. a disc member interposed between the cap member and the diaphragm member, wherein the disc member comprises: a hydrophobic filter membrane and at least one vent providing a path for air to travel from an area near the threads to the hydrophobic filter member, wherein the flexible portion of the flexible diaphragm member flexes to compensate for a change in pressure within the container by transitioning downwards in response to a decrease in pressure and by transitioning upwards in response to an increase in pressure.

2. The closure of claim 1 wherein the flexible portion of the flexible diaphragm is bellows-shaped in its first position.

3. The closure of claim 1 wherein the at least one vent comprises a series of grooves that extend outwardly from the filter membrane towards the area near the threads.

4. The closure of claim 1 wherein the disc member is flexible plastic disc.

5. The closure of claim 1 wherein the flexible diaphragm member is made from a thermoplastic polymer selected from the group consisting of: elastomer styrenics, polyolefins, low density polyethylene, high-density polyethylene, linear low-density polyethylene, ultra low-density polyethylene, polyurethanes polyethers and polyesters, etherest-erelastomers copolyesters, polyamides, melt processible rubbers, vulcanizates, and mixtures and/or co-polymers thereof.

6. The closure of claim 1 wherein the flexible diaphragm member is made from a thermoset rubber selected from the group consisting of: butadiene rubber, butyl rubber, chlorosulfonated polyethylene, epichlorohydrin rubber, ethylene propylene diene monomer, ethylene propylene rubber, floroelastomers, nitrile rubber, perfluoroelastomer, polyacrylate rubber, polycholorprene, polyisoprene, polysulfide rubber, silicon rubber, styrene butadiene rubber, and mixture and/or co-polymers thereof.

7. The closure of claim 1 wherein the hydrophobic filter member is made from a hydrophobic material selected from the group consisting of: polytetrafluoro-ethylene, polypropylene, and a mixture thereof.

8. The closure of claim 1 wherein the hydrophobic filter membrane has a porosity of between 20 and 40 percent and an average pore size of from about 0.3 to 5.0 microns.

9. The closure of claim 8 wherein the average pore size of the membrane is from about 0.4 to 2.0 microns.

10. The closure of claim 9 wherein the average pore size of the membrane is from about 0.5 to 1.5 microns.

* * * * *